US006056438A

United States Patent [19]

Bradley

[11] Patent Number: 6,056,438

[45] **Date of Patent: *May 2, 2000**

[54] GEOTEXTILE CONTAINER AND METHOD OF PRODUCING SAME

[75] Inventor: Anthony S. Bradley, Valparaiso, Fla.

[73] Assignee: Bradley Industrial Textiles, Inc., Valparaiso, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 09/163,122

[22] Filed: Sep. 29, 1998

Related U.S. Application Data

[62] Division of application No. 08/870,525, Jun. 6, 1997, Pat. No. 5,902,070.

[51] Int. Cl.[7] ..... B65D 30/04; B65D 30/10

[52] U.S. Cl. ..... 383/66; 112/475.08; 383/107; 383/117; 405/17; 405/19; 405/21

[58] Field of Search ..... 383/107, 66, 117; 112/475.08; 405/17, 19, 21

[56] References Cited

U.S. PATENT DOCUMENTS

| | | | |
|---|---|---|---|
| 490,103 | 1/1893 | Collins | 383/107 |
| 781,494 | 1/1905 | Coltharp . | |
| 815,255 | 3/1906 | Bell | 383/107 |
| 909,423 | 1/1909 | Keller . | |
| 1,206,417 | 11/1916 | Cunkle . | |
| 1,211,853 | 1/1917 | Huggins | 383/66 |
| 1,642,204 | 9/1927 | Hill . | |
| 2,588,695 | 3/1952 | Brady et al. . | |
| 3,340,919 | 9/1967 | Holbrook | 383/117 |
| 3,373,568 | 3/1968 | Hornbostel . | |
| 3,561,219 | 2/1971 | Nishizawa et al. . | |
| 3,696,623 | 10/1972 | Heine et al. . | |
| 3,886,751 | 6/1975 | Labora . | |
| 3,957,098 | 5/1976 | Hepworth et al. . | |
| 4,275,493 | 6/1981 | Matovich et al. . | |
| 4,690,585 | 9/1987 | Holmberg . | |
| 4,696,244 | 9/1987 | Sampson et al. | 112/262.1 |
| 4,878,446 | 11/1989 | Vermeulen . | |
| 5,098,754 | 3/1992 | Horstmyer . | |
| 5,492,073 | 2/1996 | Abraham . | |
| 5,505,557 | 4/1996 | Bradley . | |
| 5,595,458 | 1/1997 | Grabhorn . | |

*Primary Examiner*—Stephen P. Garbe
*Attorney, Agent, or Firm*—Dority & Manning

[57] ABSTRACT

An improved geotextile container of the type for maintaining fill material includes a geotextile fabric configured into a tubular shape and having stitched, multi-layer, flanged seams with the stitched flange disposed inside the container. Due to this construction, outwardly directed forces imparted by the fill material will be directed against the stitching. An embodiment with an outer layer of geotextile material has an inner liner of geotextile material.

13 Claims, 10 Drawing Sheets

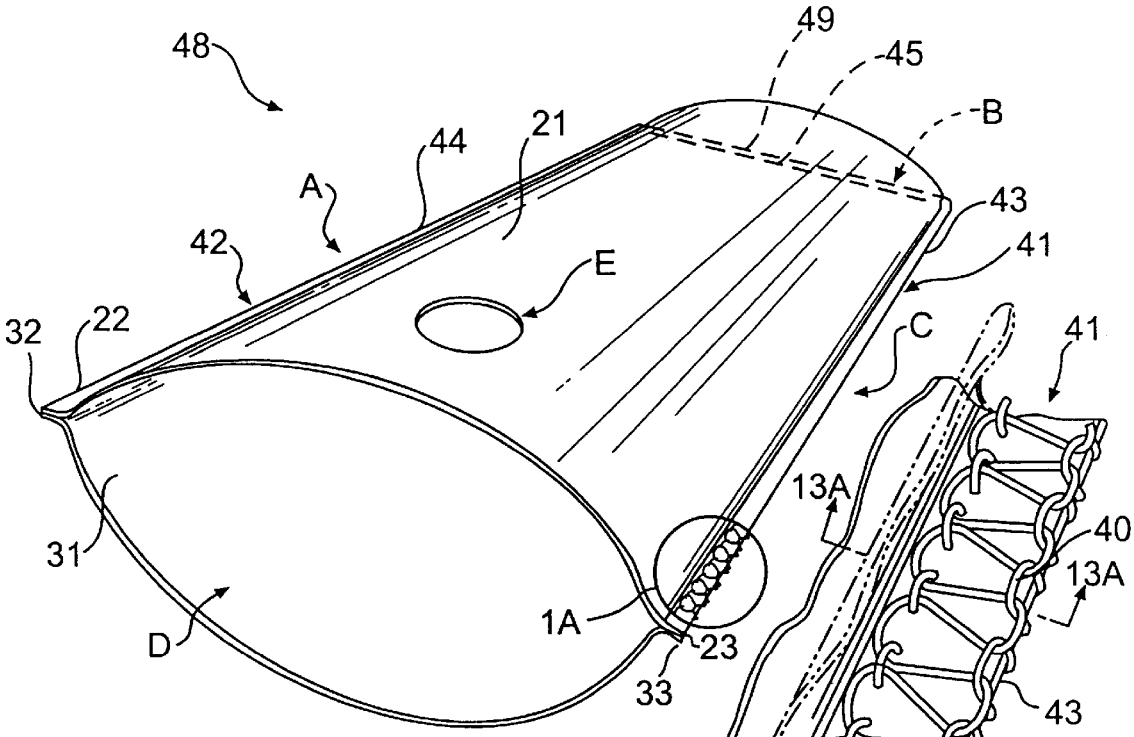
FIG. 1
FIG. 1A
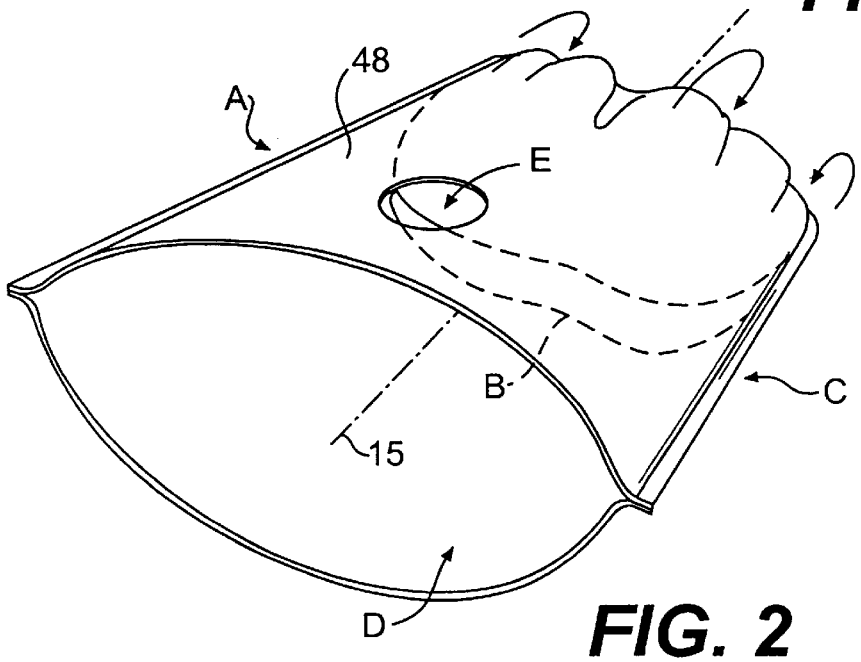
FIG. 2

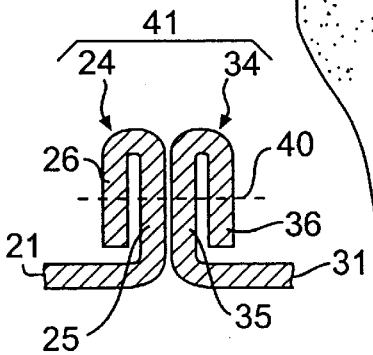
FIG. 13A
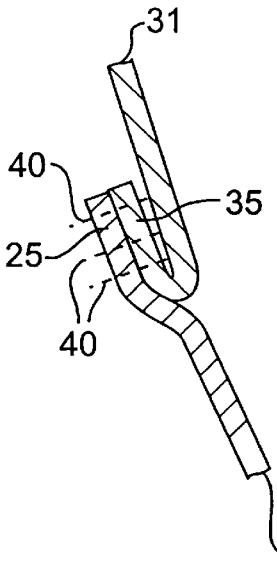
FIG. 13B
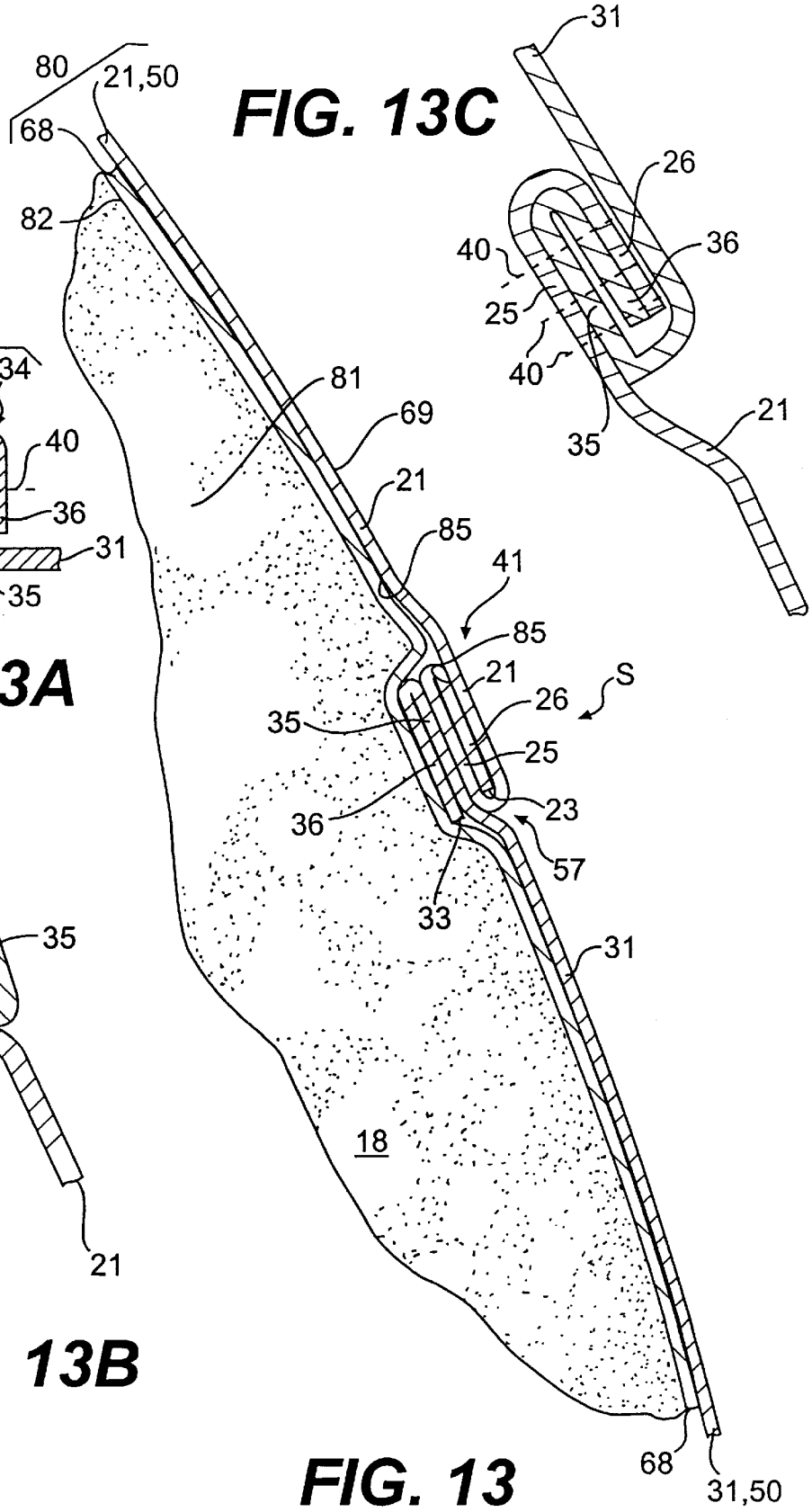
FIG. 13C
FIG. 13

GEOTEXTILE CONTAINER AND METHOD OF PRODUCING SAME

CROSS-REFERENCE TO RELATED APPLICATIONS

This application is a divisional of application Ser. No. 08/870,525, filed Jun. 6, 1997, now U.S. Pat. No. 5,902,070.

BACKGROUND OF THE INVENTION

The present invention relates to the art of geotextile containers of the type for maintaining fill material.

Geotextile containers adapted to serve as receptacles for soil, aggregate or other fill material are utilized in a variety of applications. For example, elongated geotextile containers such as the bags that are disclosed in U.S. Pat. No. 3,957,098 are often utilized in a body of water, such as a bay or a river, to facilitate control of erosion. Such bags are formed of two layers of rectangular fabric overlying each other. Each long edge of each layer is double-stitched with lock stitches to the opposed long edge of the other layer. In a typical application, an elongated container of this type may be situated to extend generally in parallel, perpendicular or at various angles with respect to the shoreline. Such a container may be filled with material dredged from the bottom of the body of water to provide weight to maintain the container in position. The area between the container and the shoreline may be backfilled with soil to effectively extend the shoreline farther out into the body of water. Containers of this type may also be used as a receptacle for contaminated material.

An elongated geotextile container may have a length of up to about 2,000 feet or more. The circumference will generally depend on the desired barrier height, but a circumference of about forty-five (45) feet or more is also not unusual. When the container is filled, it can be under water and can include an inner liner and an outer shell. The hydrostatic pressure on the outside of a submerged container, must be overcome by the dredging pumps that are used to fill the container in order to displace the water atop and inside the container. Thus, the pressure applied by these pumps, as well as the weight of the fill inserted into the container, will result in outwardly directed forces that stress the geotextile fabric and the seams that join the sheets of the fabric composing the container. The rupture strength of the geotextile material composing each sheet in the container structure, can be on the order of 1000 pounds of force, depending on a number of factors. These factors include the polymer composition of the fabric, the weave, and the denier of the fibers in the fabric.

However, the rupture strength of each of the seams that connects adjacent sheets of geotextile material composing the container, is believed to be on the order of 50% of the strength of the geotextile fabric composing the sheet and depends upon the type of seam, the polymer composing the fabric, the polymer composing the sewing thread, the denier of the sewing thread, and the type of stitch made with the sewing thread. Accordingly, the seams are the weakest link in the construction of the container. The strength of the seams determines the maximum force to which the container can be subjected, before the container will burst and thus fail.

The problems posed by the relatively weak sewn seams in each end of an elongated geotextile container, have been addressed in one container of the type disclosed in commonly assigned U.S. Pat. No. 5,505,557, which is hereby incorporated herein by this reference. A bag defining an inner cavity permits the fill material to be contained therein. The bag is constructed of at least two elongated rectangular sheets of a flexible material opposed to one another and sewn along the opposed long edges to form at least two axial seams and sewn along the opposed short edges to form at least one end seam at a closed end. The closed end is back-folded into the inner cavity to form a pouch. An outer surface of the bag thus defines an inner surface of the pouch. Likewise, an inner surface of the bag defines an outer surface of the pouch. At least one anchor object is positioned in the pouch and tied off by a clamping mechanism situated about a neck portion of the pouch. As a result, the pouch is closed and the anchor object is maintained on the inside thereof. Due to this construction, an axially outward force imparted by the fill material will be directed against the inner surface of the bag instead of directly against the end seam in the closed end. However, this solution does not address the adverse effect of the radially directed forces upon the longitudinal seams of the container.

Moreover, because of the large circumferences of some geotextile containers, if a single wide sheet is desired to span the circumference of the container, a very large (and expensive) loom is needed to weave the sheet of such width. Alternatively, a number of smaller width sheets must be seamed together along their lengths to form a single large diameter container. In another alternative, a number of smaller diameter containers must be bundled together to attain the desired overall diameter required by the application. However, each of these latter alternatives results in a number of longitudinal seams, which are less desirable as noted above. Moreover, even a container formed of a single sheet of massive width, nonetheless has at least one longitudinal seam that is believed to reduce the strength of the overall container by 50% of the strength of the fabric forming such sheet of geotextile material.

Still another alternative relies on a circular loom to produce a fabric in a continuous tubular shape without any longitudinal seam. However, this alternative also has its limitations. The tubular fabric woven by such circular looms does not have the large circumference that is desired. Such circular looms are themselves more expensive than a conventional loom. Such circular looms cannot weave some types of synthetic yarns that are desirable for forming the heavier and stronger fabrics, which are desirable for their strength and for the larger circumference applications. This is due to the inability of a circular loom to weave a fabric composed of yarns that are relatively thick and/or stiff.

OBJECTS AND SUMMARY OF THE INVENTION

The present invention recognizes and addresses the foregoing disadvantages, and others, of prior art constructions and methods. Accordingly, it is an object of the present invention to provide an improved geotextile container and method of making same.

It is a more particular object of the present invention to provide an improved geotextile container that has an improved structure for reinforcing the seams of a tubular geotextile bag.

It is another particular object of the present invention to provide an improved geotextile container that has a seam which enhances the overall strength of a tubular geotextile bag rather than serving as the weakest part.

It is a further object of the present invention to provide an improved method of reinforcing the seams of a tubular geotextile bag.

It is another object of the present invention to provide an improved geotextile container that has seams along the length thereof with enhanced ability to resist stress when compared with containers of the prior art.

It is yet another object of the present invention to provide an improved method of making a geotextile container wherein the improved method enables the manufacture of large circumference containers with much smaller looms than heretofore possible with methods of the prior art.

It is a still further object of the present invention to provide an improved method of making a geotextile container wherein the improved method enables the manufacture of large circumference containers with a conventional loom rather than a circular loom as in some of the prior art.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an improved geotextile container of the type for maintaining fill material includes a geotextile fabric configured into a tubular shape and having stitched seams. The geotextile fabric can be either permeable or non-permeable to water, as the application for the container demands. Each seam, both longitudinal and end, that joins adjacent sheets of geotextile material is formed in part by the flaps disposed along the border region near the respective edges of the adjacent sheets. A line of stitching is sewn through the opposed flaps to form a stitched flange that forms part of that seam of the container. The flange can be desirably formed as in a butt seam (also known as a "prayer" seam), or a "J" seam, or a butterfly seam. The stitching can take any of a number of forms, including for example a single needle stitch, or an over edge (serge) stitch, or a double lock stitch. Each such stitched flange is disposed with the stitching disposed inside the container. With the sewn fabric flanges so oriented, it is believed that the fill material flattens the flange against the inside surface of the container and thereby directs the outwardly directed stress forces against the side of the fabric flange. In this way, the force of the fill material is believed to press the opposed faces of each fabric seam together rather than wedging them apart.

A desirable container embodiment is formed from a single sheet of geotextile material that is furled into a tubular shape with a helical seam along the length thereof instead of one or more longitudinal straight seams. This helical seam desirably takes the form described above with the flange and stitching disposed inside the inner cavity of the container. This helical seam further strengthens the container by acting as might a reinforcing rope wound around the container along the length thereof. In a related container embodiment, more than one sheet can be furled side-by-side into a single tubular shape and have each of their adjacent side edges joined by an helical seam so that the container has more than one parallel helical seam.

An alternative container embodiment with a helical seam along the length thereof, has an inner liner or an outer shell having one or more longitudinal straight seams formed of the inwardly disposed sewn fabric flanges. The helical seams resist one set of stresses and the longitudinal seams resist another set of stresses so that the combination of the longitudinal seams and the helical seams provides a stronger overall container.

Yet another embodiment of the container of the present invention, includes a geotextile container with at least two layers of geotextile material. An inner layer of geotextile material has a first helical seam that corkscrews in one direction. An outer layer of geotextile material surrounds the inner layer and has a second helical seam that corkscrews in a second direction that is out of phase with the direction of the first helical seam of the inner layer. In this embodiment, the one helical seam is normal to the other helical seam and thus intersects the other helical seam as each winds around its respective layer of geotextile material. Thus, one might say that the pitch of the first helical seam is generally out of phase with the pitch of the second helical seam. In this embodiment, the two helical seams further strengthen the container by acting as might two oppositely wound reinforcing ropes wrapped around the container along the length thereof in opposite directions. Each helical seam resists stresses in a different region of the container so that the combination provides a stronger overall container.

Other objects of the invention are achieved by a method of reinforcing a seamed end of a tubular geotextile bag of the type having an inner cavity for maintaining fill material. The method comprises the step of pulling the unsewn ends through the port hole disposed near the end of the container. Then said ends are joined by forming the above-described sewn fabric flanges to form an everted sewn end. Fill material may then be inserted into the inner cavity, whereby an outward force imparted on the bag by the fill material will be directed against an everted seam of the bag instead of a straight seam.

These and other objects, features and aspects of the present invention are discussed in greater detail below. The accompanying drawings, which are incorporated in and constitute a part of this specification, illustrate several embodiments of the invention and, together with the description, serve to explain the principles of the invention.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which:

FIG. 1 is an elevated perspective view illustrating initial steps in the construction of a preferred embodiment of an elongated liner or geotextile container of the present invention;

FIG. 1A is an enlarged perspective view of the section designated 1A in each of FIGS. 1 and 6;

FIG. 2 is an elevated perspective view illustrating intermediate steps in the construction of the embodiment of FIG. 1;

FIG. 13 is a cross-sectional view of the helical seam taken along the line of sight designated by the arrows pointing towards the numbers 13—13 in FIG. 12;

FIG. 13A is a cross-sectional view of an alternative embodiment of a seam taken along the line of sight designated by the arrows pointing towards the numbers 13A—13A in FIG. 1A for example;

FIG. 13B is a cross-sectional view of an alternative embodiment of a seam taken along the line of sight designated by the arrows pointing towards the numbers 13—13 in FIG. 12 for example;

FIG. 13C is a cross-sectional view of an alternative embodiment of a seam taken along the line of sight designated by the arrows pointing towards the numbers 13—13 in FIG. 12 for example;

DETAILED DESCRIPTION OF THE PREFERRED EMBODIMENTS

Figure 3:
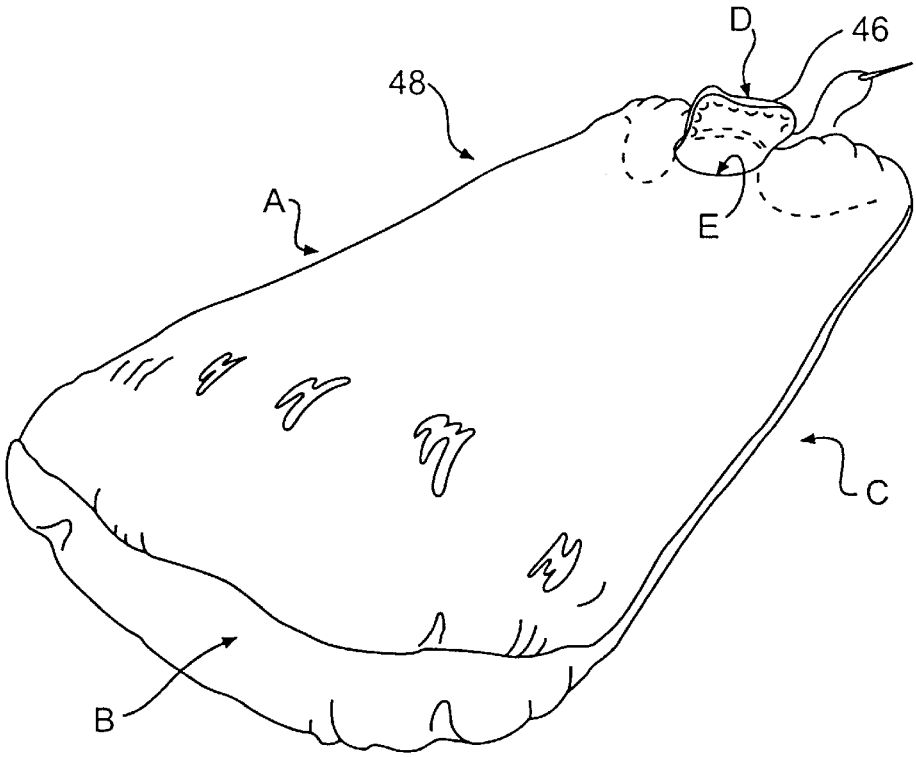
FIG. 3 is an elevated perspective view illustrating final steps in the construction of the embodiment of FIGS. 1 and 2.

Reference now will be made in detail to the presently preferred embodiments of the invention, and examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Repeat use of reference characters in the present specifications and drawings is intended to represent same or analogous features or elements of the invention.

Figure 4:
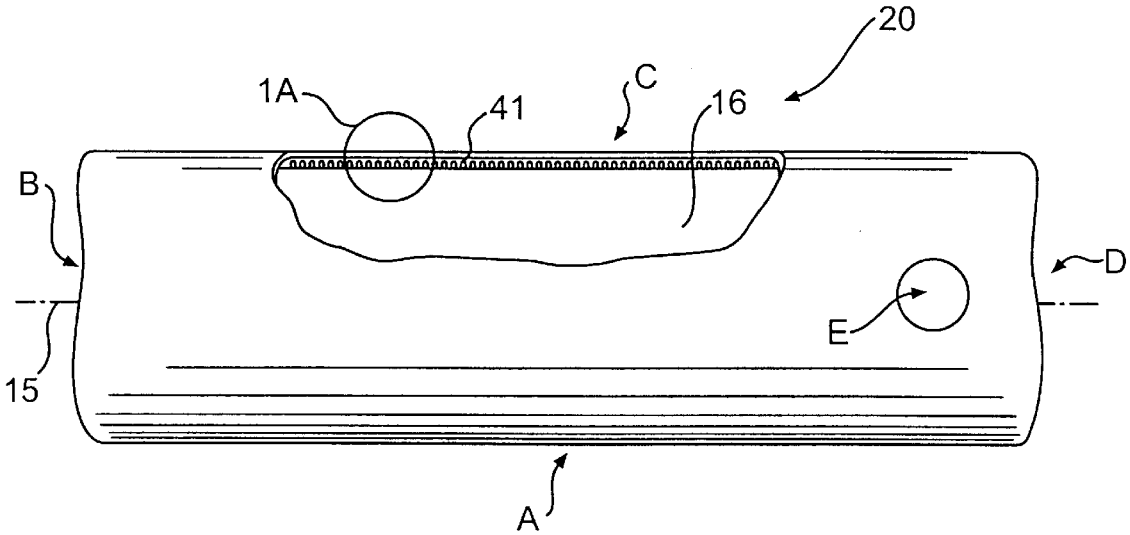
FIG. 4 is a top plan view of an embodiment of an elongated liner or geotextile container of the present invention constructed in the manner shown in FIGS. 1–3.

A preferred embodiment of a geotextile container in accordance with the present invention is shown in FIG. 4 in the form of an elongated tubular geotextile bag that is represented generally by the numeral 20. Bag 20 has a pair of opposed sides labeled A and C and a pair of opposed ends labeled B and D. Bag 20 is made in accordance with the steps illustrated schematically in FIGS. 1–3 for example. A single sheet embodiment could be made or a plurality of elongated sheets of geotextile material could be joined together and used as a single sheet. However, as shown in FIGS. 1–3, two sheets 21 and 31 are shown for the sake of making the explanation of the construction easier to understand.

The geotextile material that forms each of a first sheet 21, a second sheet 31, and any additional sheets in the construction, is woven from synthetic fibers such as nylon, polypropylene, polyester, polyethylene or any combination of the foregoing fibers. Each resulting sheet desirably is formed such that it can withstand forces appropriate to the application for which the resulting container is intended to be used. Thus, a rupture strength of 200 pounds will suffice for some applications, while other applications will require the sheet to withstand on the order of 1000 pounds without rupturing.

Each sheet of geotextile material has an elongated first side edge and an elongated first end edge that is contiguous with the elongated first side edge. In addition, each sheet further has an elongated second side edge that is contiguous with the elongated first end edge. The elongated second side edge is disposed generally opposite the elongated first side edge. Each sheet also has a second end edge that is contiguous with each of the first side edge and the second side edge. The second end edge is also disposed generally opposite the first side edge. Thus, the width of each sheet is bounded by its side edges. The length of each sheet is bounded by its end edges.

As shown in FIG. 1 for example, a first sheet 21 of geotextile material is disposed with respect to a second sheet 31 of geotextile material so that a first side edge 23 of first sheet 21 is generally aligned with a first side edge 33 of second sheet 31. Moreover, a first border region near first side edge 23 is disposed to oppose and touch a second border region near first side edge 33 of second sheet 31 so that both sheets 21, 31 are touching one another along at least their respective first and second border regions near their respective first side edges 23, 33.

In the seam embodiment shown in FIG. 1A for example, the first border region near first side edge 23 of first sheet 21 is folded back upon itself to form a first flap 24 of a doubled thickness of geotextile fabric. Similarly, the second border region near first side edge 33 of second sheet 31 is folded back upon itself to form a second flap 34 of a doubled thickness of geotextile fabric. Each respective flap 24, 34 of first sheet 21 and second sheet 31 consists of a pair of legs, namely, an opposed leg and a free leg. As shown schematically in cross-section in FIG. 13A for example, a first opposed leg 25 of first sheet 21 is disposed in contact with a second opposed leg 35 of second sheet 31 along their lengths. However, FIG. 13A does not actually show the various legs in actual contact in order to simplify the drawing and make it easier for the viewer to follow the explanation of the construction. First flap 24 then has its free leg 26 disposed to face what is presently the outside surface of first sheet 21. Accordingly, free leg 26 is disposed to face away from the opposed second sheet 31 of geotextile material. Similarly, second flap 34 then has its free leg 36 disposed to face what is presently the outside of second sheet 31, i.e., away from the opposed first sheet 21 of geotextile material.

A means is provided for joining the sheets along their opposed border regions to form at least part of a seam. As embodied herein, this joining means includes a first line of stitching, which is generally designated by the numeral 40 in FIG. 1A and schematically by the dashed line designated 40 in FIG. 13A. First line of stitching 40 is applied through both opposed touching flaps 24, 34 to join first sheet 21 and second sheet 31 and to form a first sewn stitched flange, which is generally designated by the numeral 41 in FIGS. 1A and 13A. In the embodiment shown in FIGS. 1A and 13A, first flange 41 is composed of four thicknesses of geotextile material and forms part of what is sometimes known as a butterfly seam. As shown in FIG. 1A, first line of stitching 40 is disposed in the border near respective first side edges 23, 33 of first sheet 21 and second sheet 31. As shown in FIG. 1A, first line of stitching 40 desirably is formed as a plurality of double lock stitches that are sewn through flange 41.

While the seam described above is a butterfly seam, other types of seams can be used in accordance with the present invention, both for the seam described above and the other seams to be described below. The other types of seams suitable for the present invention, desirably are multi-layer seams that include a flange 41. Two examples are a butt seam (also known as a "prayer" seam) and a "J" seam. As shown in cross-section in FIG. 13B, a butt seam that joins a first sheet 21 to a second sheet 31 includes a first opposed leg 25 in contact with a second opposed leg 35, and stitching, which is schematically represented by the dashed lines designated by the number 40. Similarly, as shown in cross-section in FIG. 13C, a "J" seam that joins a first sheet 21 to a second sheet 31 includes a first opposed leg 25 in contact with a second opposed leg 35, and stitching, which is schematically represented by the dashed lines designated by the number 40. The "J" seam also includes a first free leg 26 and a second free leg 36. The seams shown in the views of FIGS. 13B and 13C are in an orientation comparable to the view shown in FIG. 13 in that the seam is flattened against the joined sheets of material as would occur when the geotextile container is filled with the fill material. Moreover, the stitching 40 can take any of a number of forms, including for example a single needle stitch, or an over edge (serge) stitch, or a double lock stitch such as shown in FIG. 1A.

As schematically shown in FIG. 1 for example, the above sewing procedure is repeated with a second side edge 22 of first sheet 21, a second side edge 32 of second sheet 31, and at least a second line of stitching forming a second flange 42. The application of the second line of stitching results in a flange configured the same as first flange 41 shown in FIG. 1A for example. The resulting structure (not shown in the Figs.) is a sewn tubular structure open at each opposite end with a pair of sewn flanges 41, 42 along the respective opposite sides C, A of the length of the tubular sleeve (not shown in the Figs.). As shown in FIGS. 1 and 1A for example, the sewn flanges 41, 42 extend with the respective free edges 43, 44 of the flanges 41, 42 pointing away from the outside surface of the tubular structure.

The above sewing procedure is then repeated with the respective first end edges of first sheet 21 and second sheet 31 and at least a third line of stitching. As shown in FIG. 1, the result is a sewn flange 45 at a first closed end designated by the letter "B." The application of the third line of stitching results in a flange 45 configured the same as first flange 41 shown in FIG. 1A for example. Flange 45 extends between and is contiguous with the sewn flanges 41, 42 along the opposite sides of the resulting structure, which becomes open at one end and closed at one opposite end to form a sack structure 48. As shown in FIG. 1 for example, the sewn flange 45 of the closed end also extends with the free edge 49 thereof pointing away from the outside of sack 48. As shown in FIG. 1, one of the sides of sack 48 is schematically indicated by the letter "A," and the opposite side of sack 48 is schematically indicated by the letter "C." The open end of sack 48 is schematically indicated by the letter "D."

Note in FIGS. 1–4 that a port hole is defined through first sheet 21 by an opening indicated generally by the letter "E." Port hole E is desirably formed near the open end D of sack 48.

As shown schematically in FIG. 2 for example, once sack 48 is formed by closing one end of the tubular structure, sack 48 is everted. The closed end B of sack 48 is pulled from inside the sack toward the open end D of sack 48. Moreover, closed end B of sack 48 is pulled completely out and through open end D of sack 48 until sack 48 is turned completely inside out so that all of the flanges 41, 42, 45 and their respective lines of stitching become disposed inside sack 48, as shown in FIGS. 4 and 13 (flange 41 only) for example. This also disposes sewn flanges 41, 42, 45 so that their respective free edges 43, 44, 49 point toward the central longitudinal axis 15 (FIG. 2) of sack 48.

The open second end D of sack 48 is now closed in a manner that disposes the closure seam inside the resulting closed sack structure. As shown in FIG. 3, the second end edges at second end D of sack 48 are pulled through port hole E to the outside of sack 48. The end border region near the second end edge of each sheet is folded back upon itself to form a flap of a doubled thickness of fabric (as shown in FIGS. 1A and 13 for example). These flaps are opposed to face against each other along the lengths of their opposed legs. As schematically shown by the needle and thread depicted in FIG. 3, at least a fourth line of stitching is applied through both opposed touching flaps to join first and second sheets 21, 31 and form a fourth sewn stitched flange 46 of four thicknesses of geotextile material. This fourth line of stitching is disposed in the border near the respective second end edges of first sheet 21 and second sheet 31. The application of the fourth line of stitching results in a flange 46 configured as first flange 41 shown in FIG. 1A for example. As shown in FIG. 1A, the fourth line of stitching desirably is formed as a plurality of double lock stitches through the quadruple thickness flange in the border region near the respective second end edges of each first and second sheet. Thus, this fourth line of stitching is applied to join the second end edges near the border portion thereof while these second end edges are exposed outside of sack 48 via port hole E. In this way, the fourth line of stitching closes second end D of sack 48. Once the closure is accomplished, the second end edges and fourth line of stitching composing fourth sewn flange 46 are pushed back through port hole E into the inner cavity of the resulting closed sack structure.

Thus, as shown in FIG. 4, sack 48 is transformed into a bag 20, which can be used as a geotextile container. As noted, bag 20 has an inner cavity 16, and the flanges 41, 42, 45, 46 form the portion of the seams of bag 20 that face inside inner cavity 16. As shown in FIG. 13 for example, when the inner cavity is filled with the solid matter 18 composing the fill material, the solid fill material will apply an outwardly directed force on the inside surface of bag 20. It is believed that this outwardly directed force will be directed against each sewn flange and the line of stitching therein along a line that is perpendicular to one of the two free legs of one of the flaps forming the flange. For example, if one ignores the inner liner 68 in FIG. 13, the fill material 18 will apply an outwardly directed force along a line that is perpendicular to free leg 36 of the flap forming flange 41. With the sewn fabric flanges 41, 42, 45, 46 so oriented, it is believed that the solid fill material 18 flattens each flange against the inside surface of the container and thereby directs the outwardly directed stress forces from the weight of the fill material, against the free leg that forms the side of the fabric flange facing the fill material. In this way, as shown in FIG. 13 for example, the force of the solid fill material is believed to press the opposed legs 25, 35 of the fabric flange 41 together rather than wedging them apart. It is believed that this pressure acts to reinforce the seams of bag 20 by keeping the four thicknesses of material in the seam, pressed together. Instead of the internal pressure acting to pry the seam apart, the pressure appears to act to keep the seam from separating.

Figure 10:
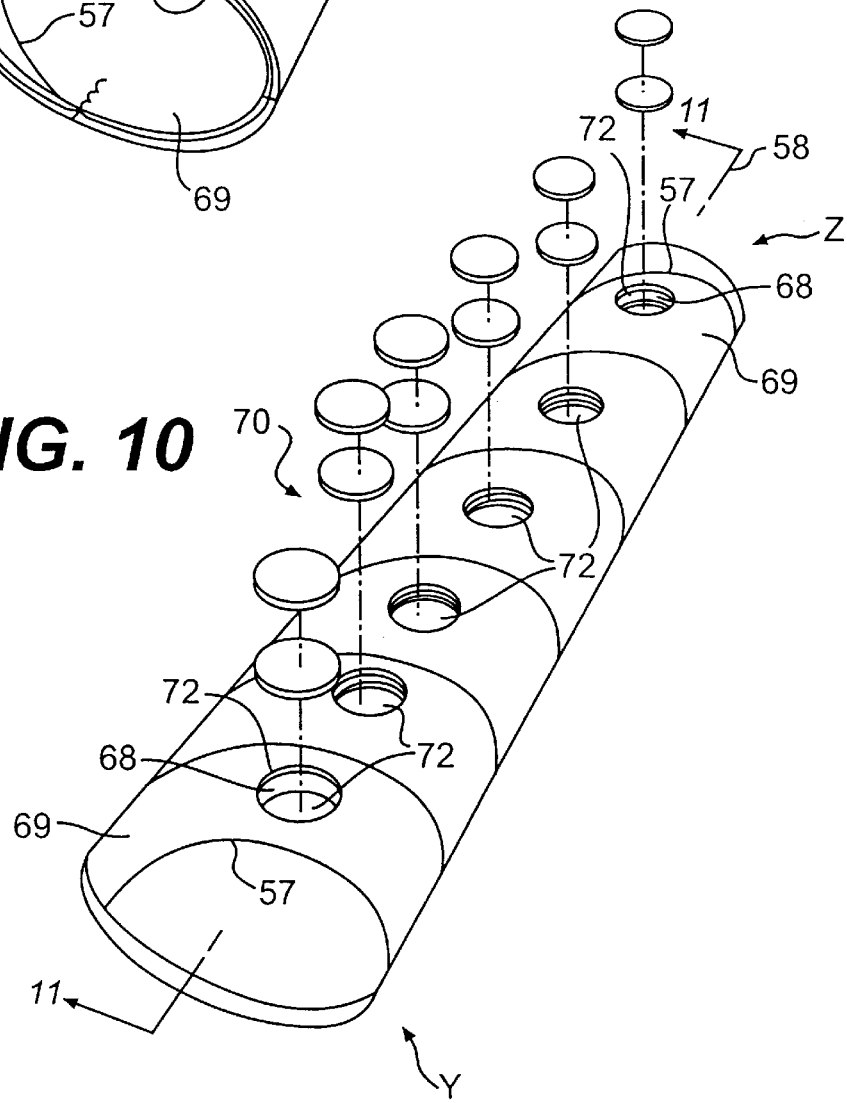
FIG. 10 is an elevated perspective view illustrating further intermediate steps in the construction of the embodiment begun in FIGS. 5–9.

Additional port holes can be provided to bag 20, as needed and shown for example in the embodiment depicted in FIG. 10. The number of port holes is dependent upon the application for which the container is to be used. For example, some port holes can be used to bring fill material 18 into inner cavity 16, and some port holes can be used to permit expulsion of water displaced from cavity 16 as bag 20 is filled with solid fill material 18.

As noted above, though only two sheets are shown to compose bag 20 in the embodiment illustrated in FIGS. 1–4, additional sheets could be incorporated into the resulting container shown in FIG. 4. Such additional sheets would be joined at their respective side edges in the same manner as first and second side edges are joined as described above. Similarly, the end edges at one end of each sheet would be joined together in a manner similar to the two end edges joined as shown in FIG. 1 at the end B of the closed tubular structure forming sack 48. Then the end edges at the opposite end of each sheet would be joined together in a manner similar to the two end edges joined as shown in FIG. 3 at end D.

Figure 5:
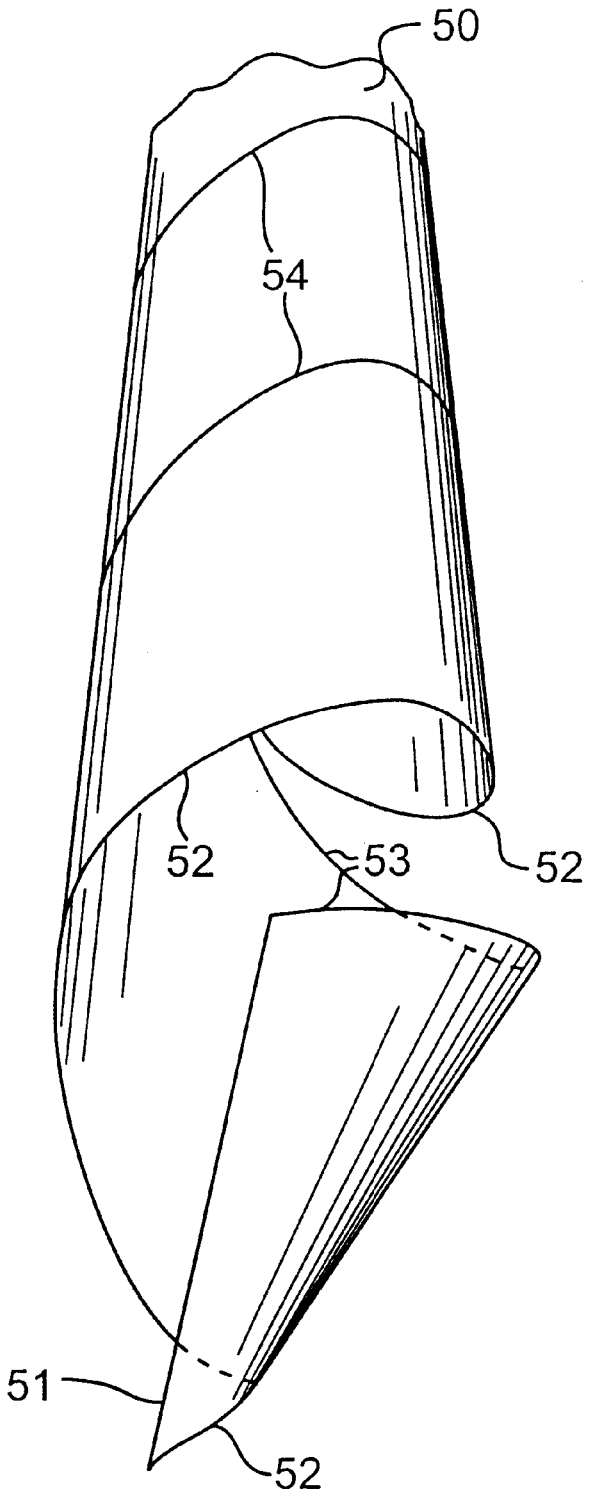
FIG. 5 is an elevated perspective view illustrating initial steps in the construction of another preferred embodiment of an elongated geotextile container or liner of the present invention.

An alternative preferred embodiment of the present invention addresses the need to be able to generate geotextile containers of relatively large circumference with a relatively small width loom and in particular to generate geotextile containers made from fabric sheets of geotextile material that has a width smaller than the desired circumference of the geotextile container. The construction of this embodiment is illustrated schematically in FIGS. 5–13 and 3 for example. As shown in FIG. 5, an elongated rectangular sheet 50 of geotextile material is provided from a loom having a width corresponding to the width of a first end edge 51 and a second end edge (not shown in the Figs.) of sheet 50. As shown in FIG. 5, elongated first side edge 53 is contiguous with first end edge 51. Elongated second side edge 52 is also contiguous with first end edge 51. A second end edge of sheet 50 is not visible in the view shown in FIG. 5, but is contiguous with first and second side edges 53, 52, respectively.

Figure 14:
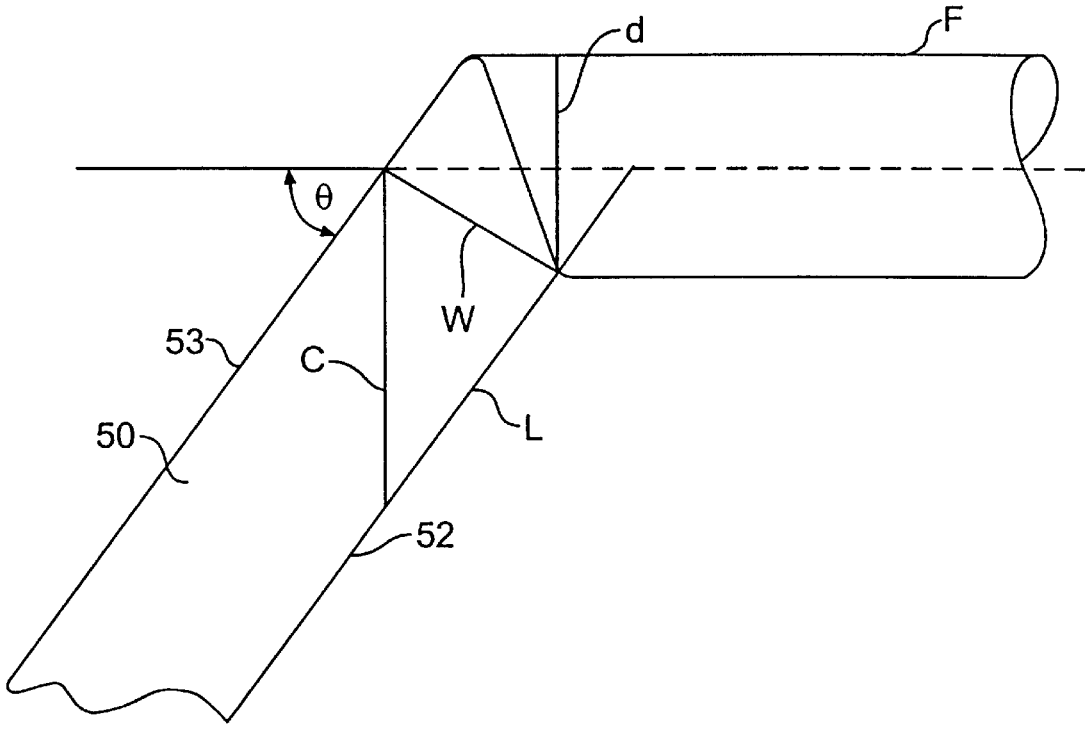
FIG. 14 is a schematic representation illustrating various spatial relationships in the formation of a tube with a spiral connecting seam.

As shown in FIG. 14, the circumference "C" of the spiral tube to be formed by sheet 50 is the hypotenuse of the right triangle that includes the spiral length "L" as one leg and the width W of sheet 50 as the other leg of the triangle, wherein the angle $\theta$ is the forming angle. The circumference of the spiral tube F (FIG. 6) is thus equal to pi ($\pi$) times the mean diameter "d" of the tube F. The length of sheet 50 will depend upon the desired size of the geotextile container in question and will require an elongated first side edge 53 of said length as well as an elongated second side edge 52 of said length.

Figure 6:
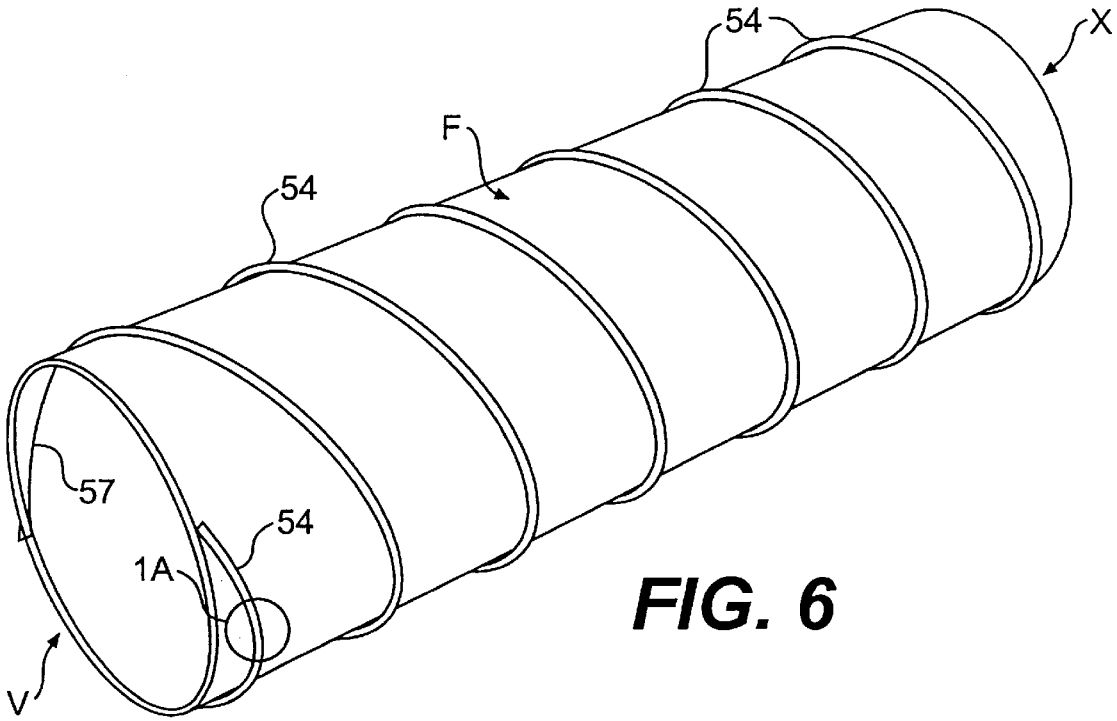
FIG. 6 is an elevated perspective view illustrating intermediate steps in the construction of the embodiment begun in FIG. 5.

As shown in FIG. 5, sheet 50 is furled in an helical shape such that first side edge 53 is overlapped on second side edge 52. A first line of stitching is applied to join first and second side edges 53, 52, respectively, in the manner described above in relation to the embodiment illustrated in FIGS. 1–4. First line of stitching is disposed where respective first side edge 53 overlaps second side edge 52 to form a continuous seam having a flange 54 on one side and a finished line of joinder 57 between adjacent sides of sheet 50. A detail of a section of seam 57 would appear as flange 41 is depicted in FIG. 1A for example. Thus, the border portion of sheet 50 near first side edge 53 can be folded back onto itself to form a flap consisting of one or two thicknesses of the sheet of geotextile material. The border portion near second side edge 52 is similarly folded back onto itself to form a flap consisting of one or two thicknesses of the sheet of geotextile material. These two flaps are placed together to form a flange 54, which is shown in FIG. 6 for example. Depending on the type of seam employed, flange 54 consists of two or four thicknesses of the sheet 50 of geotextile material. For example, flange 54 can be configured to form a butterfly seam as in FIG. 13A (four thicknesses), a butt seam as in FIG. 13B (two thicknesses) or a "J" seam as in FIG. 13C (four thicknesses). Flange 54 is sewn together by a first line of stitching, which desirably includes a plurality of double lock stitches.

Once sheet 50 is completely furled and the helical seam comprising flange 54 and joinder line 57 sewn in this manner, sheet 50 is spiraled to form a hollow tube F as shown in FIG. 6 for example. As shown in FIGS. 5 and 6, flange 54 extends in a helical line around the outside of hollow tube F. Now at this stage of construction, the open ends of tube F can be sewn closed in the same manner as described above for bag 20 shown in FIG. 4. In the course of closing a first end "V" of hollow tube F near the first free end edge of tube F, the same kind of multi-layer seam having a flange on one side and a finished joinder line on the opposite side of the seam, is used in the manner described above to form a sack 48 defining a sealed first end B.

In one alternative embodiment, this sack would be everted as shown for sack 48 in FIG. 2 for example. Then a port hole would be formed in the open end of the sack to permit closure of the open end by the formation of a multi-layer, flanged seam as described above in connection with the manufacturing steps schematically shown in FIG. 3. The resulting bag would have all of the flanges of the helical seam and the end seams disposed in the inner cavity of the bag so that upon being filled with the fill material, the flanges of the seams would be pressed against the side of the interior surface of the bag such as shown in FIG. 13 for example. Moreover, this helical seam further strengthens the container by acting as might a reinforcing rope wound around the container along the length thereof. In the case of the present invention, such rope consists of either two or four thicknesses of geotextile material, depending on the type of seam.

In a further preferred embodiment, it is desirable to provide a geotextile container composed of at least one geotextile bag nested inside another geotextile bag such that the container includes a liner disposed therein. Thus, the container will have an outer layer of geotextile material and an inner layer of geotextile material conforming to the shape of the outer layer. Moreover, such liner (inner layer) can be formed of fabric that is non-permeable to water or permeable to water, depending on the application for which the container is intended. For example, if the container is to be inflated with water before being filled, one might employ an inner liner that is non-permeable to water. On the other hand, if the container is to be filled with silt, which does not settle very well, one might employ an inner liner that is permeable to water.

Figure 7:
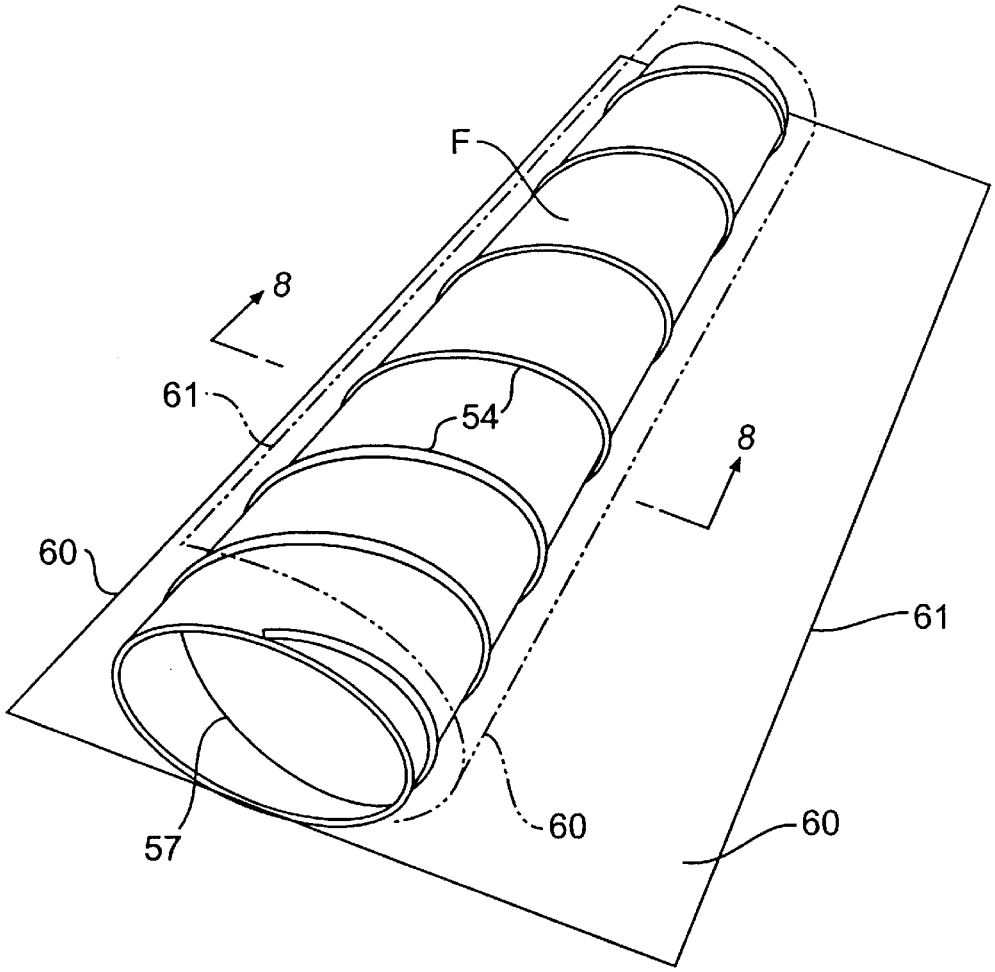
FIG. 7 is an elevated perspective view illustrating intermediate steps in the construction of the embodiment begun in FIGS. 5 and 6.

In forming this alternative preferred embodiment, furled and sewn tube F with the helical flange 54 and opposite helical joinder line 57 can be disposed upon a sheet 60 of geotextile fabric as shown in FIG. 7 for example. Sheet 60 has a width that is comparable to the circumference of tube F and a length that is comparable to the length of tube F. If necessary, one or more sheets of geotextile material can be joined together with longitudinally extending seams in a manner described above and shown in FIGS. 1 and 2 for example in order to build up to a sheet 60 of the desired width.

Then, as shown schematically in FIG. 7 by the dashed line depiction of the geotextile sheet 60, sheet 60 is wrapped snugly around tube F. The free side edges 61, 62 of sheet 60 are then joined together in a flange 64 in the same manner as described above and shown in FIGS. 1A, 13A, 13B, or 13C for example. In this way, a double-layer tube 66 is formed, as shown from an end plan view in FIG. 8.

Figure 8:
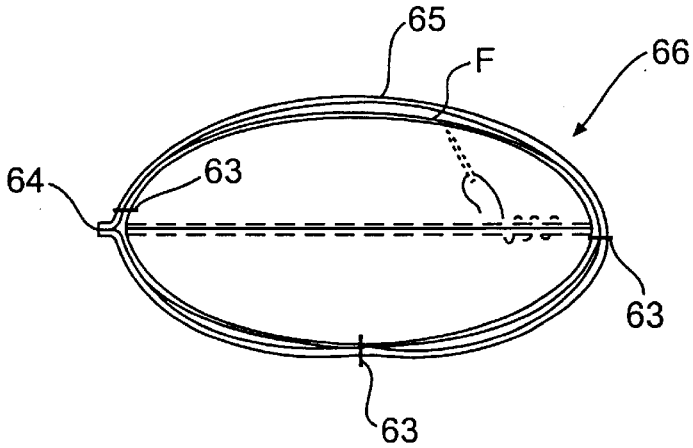
FIG. 8 is an elevated perspective view illustrating more intermediate steps in the construction of the embodiment begun in FIGS. 5–7.

As schematically shown by the needle and thread in the end on view in FIG. 8, one open end of double-layer tube 66 is sewn closed. First the end edges of the geotextile tube F, which is the inner tube nesting in the geotextile tube 65 in the view shown in FIG. 8, are joined together by a multi-layer, flanged seam. This can be accomplished as described above in connection with the description of FIG. 1 for example and result in a multi-layer, flanged seam such as shown in FIGS. 13A, 13B, or 13C. Then the end edges of the geotextile fabric tube 65, which is the outer tube in the view shown in FIG. 8, are similarly joined together by a multi-layer, flanged seam as described above. In addition, as schematically shown in an end on view depicted in FIG. 8, geotextile tube 65 and geotextile tube F are desirably tacked together by stitching 63 located in several places down the lengths of and around the circumferences of the double-layer tube 66. Similarly, the closed ends of the two tubes are desirably tacked to one another.

Figure 9:
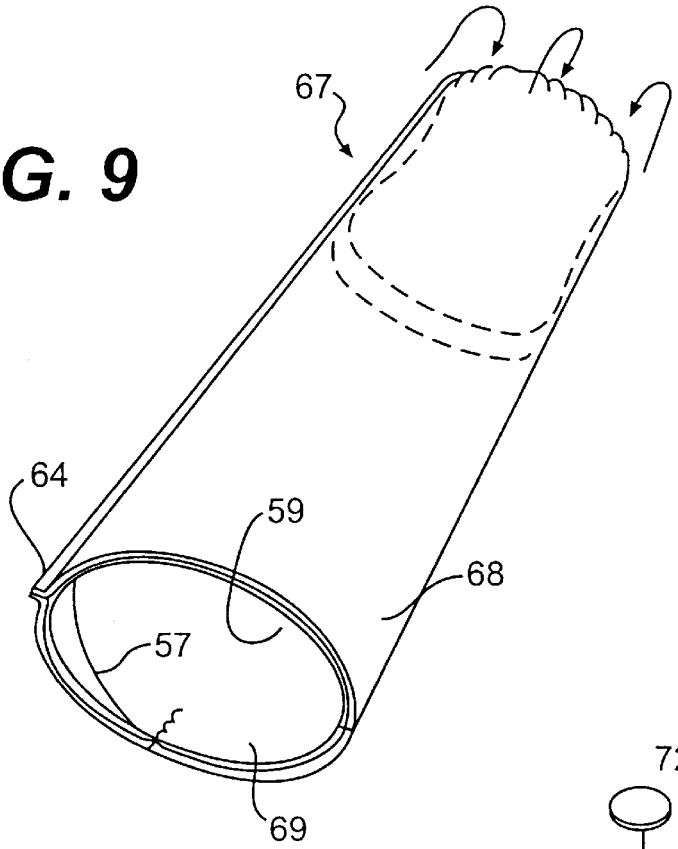
FIG. 9 is an elevated perspective view illustrating additional intermediate steps in the construction of the embodiment begun in FIGS. 5–8.

In this way, a double-layer sack (or double sack structure) 67 as shown in FIG. 9 is provided. Double-layer sack 67 has a first sack wall (or layer) 68 formed of geotextile material surrounding a second sack wall (or layer) 69 formed of geotextile material. As shown schematically in FIG. 9 for example, double-layer sack 67 is everted so that the sack's second wall 69 becomes disposed outside of the sack's first wall 68 composed of geotextile material. This eversion is accomplished by grabbing the closed end of sack 67 from inside the sack 67 and pulling the closed end into the inner cavity 59 of sack 67 as shown schematically in FIG. 9 for example. Moreover, the closed end of sack 67 is pulled completely out and through the open end of double-layer sack 67 until sack 67 is turned completely inside out so that all of the lines of stitching and sewn flanges 54, 64 become disposed inside the everted sack 67, in a manner similar to that shown in FIG. 12 for example.

The result of this eversion of double-layer sack 67 is the everted double-layer sack indicated generally in FIG. 10 by the numeral 70, but without the port holes 72 (discussed below). Everted double-layer sack 70 has a closed end Y and an open end Z. The sewn flanges of each wall or layer 68, 69 are disposed to point toward the central longitudinal axis 58 of everted double-layer sack 70. And the smooth or finished helical joinder line 57 of layer 69 is disposed outside sack 70.

As shown in FIG. 10, in a fashion similar to that which is schematically shown in FIG. 3, at least one port hole 72 is cut through both layers 68, 69 of everted double-layer sack 70 near the open end Z of everted sack 70. Additional port holes 72 can be provided in the double-layer everted sack 70. Desirably, the two layers 68, 69 of everted sack 70 are joined together around the edges of the aligned port holes 72 in the two layers.

The unclosed ends of the two layers of everted double-layer sack 70 can be sewn closed in the same manner as shown in FIG. 3 for example. First, the free end edges of the inner layer 68 of geotextile material are pulled through a port hole 72 disposed closest to the open end Z of the everted double-layer sack 70. Once these free end edges of the geotextile layer 68 are outside sack 70, they are sewn closed by the formation of a sewn flange 64 that faces inside sack 70. Then, the free end edges of the outer geotextile layer 69 are pulled through the same port hole 72 disposed closest to the open end Z of the everted double-layer sack 70, and similarly are sewn closed as a sewn flange 54 is formed to face inside sack 70.

Figure 12:
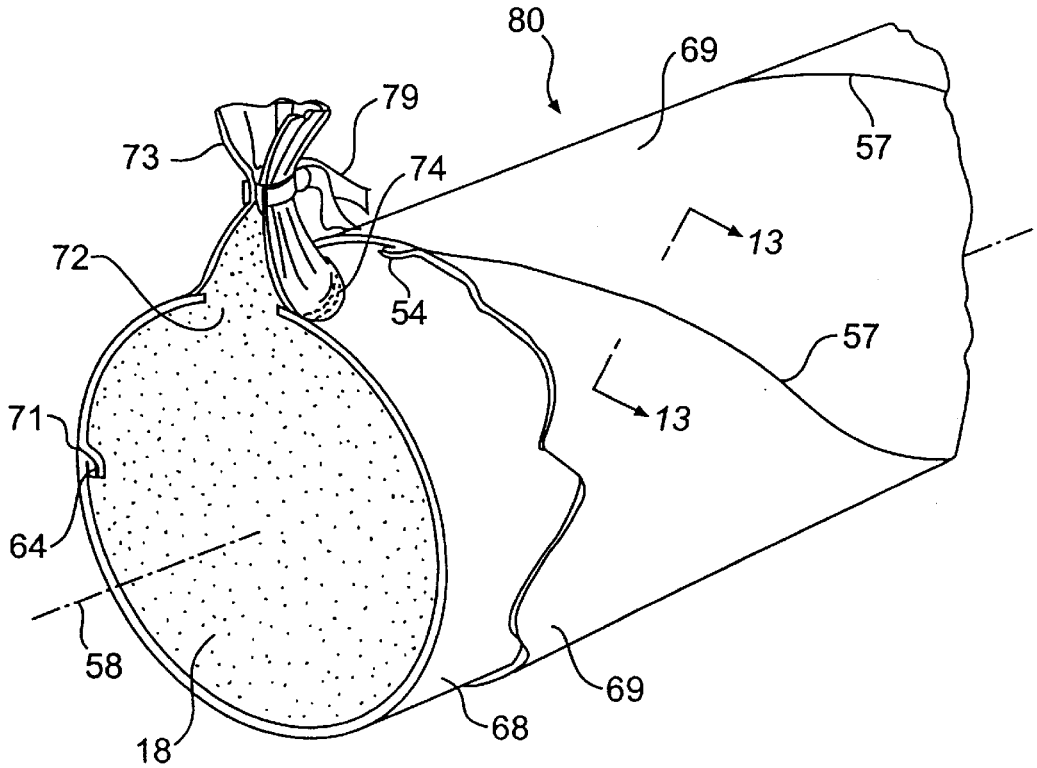
FIG. 12 is a partially cut away perspective view illustrating a section of a geotextile container constructed in accordance with the present invention when filled with material.

Closure of the open end Z of the everted double-layer sack 70 results in the formation of a geotextile container 80, which is shown in a partial section in FIG. 12. Geotextile container 80 is composed of an inner liner or layer 68 of geotextile material having elongated longitudinal seams with joinder lines 71 facing outside inner layer 68. Container 80 also includes and an outer bag or layer 69 formed of geotextile material and having a spiral, i.e., helically extending, seam with joinder line 57 facing outside container 80. As shown in FIG. 12 for example, a tubular chimney 73 formed of geotextile material for example, can be attached by stitching 74 to the container 80 around each port hole 72. Moreover, as shown in FIG. 12 for example, the longitudinal seams of the inner liner 68 are oriented substantially transverse to the helical seams of the outer layer 69. It is believed that this relative orientation of seams between the two layers of container 80, combines to provide yet additional strength is provided to the overall container 80. This additional strength is believed to enable container 80 to better withstand the outwardly directed forces resulting from the fill material 18 that eventually becomes disposed in the inner cavity of the container 18 when in use as shown in FIGS. 11B and 11C.

Figure 15:
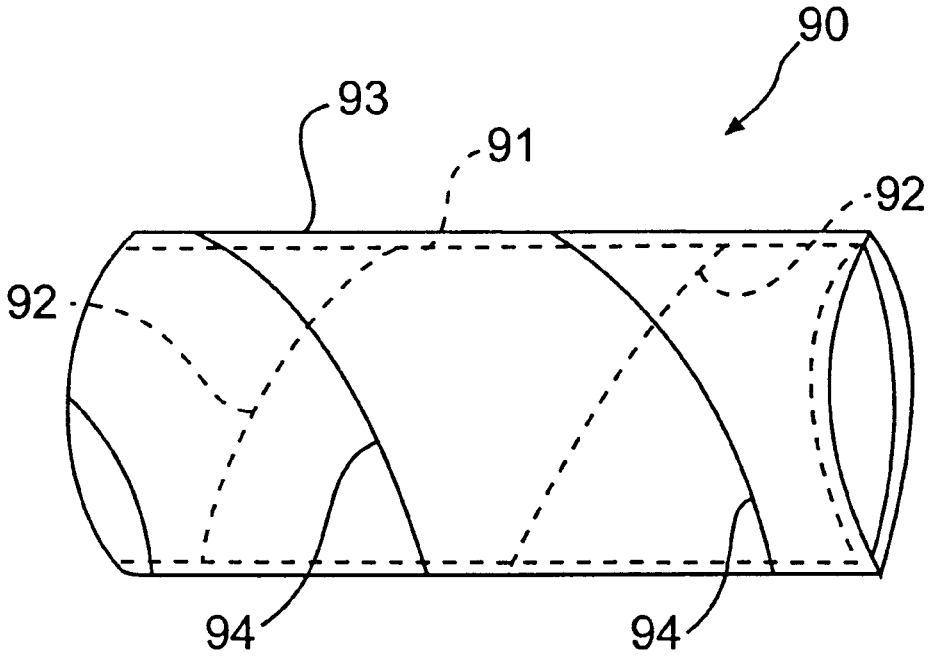
FIG. 15 is an elevated perspective view with portions shown in phantom, illustrating a section of an alternative embodiment of a double-layer geotextile container according to the present invention.

FIG. 15 illustrates a partial section of yet another embodiment of the container of the present invention. As shown therein, a geotextile container 90 has at least two layers of geotextile material, a first layer being nested inside a second layer. However, each of the layers has a helical seam having a pitch that is out of phase with the other layer's helical seam. As shown in FIG. 15 for example, an inner layer 91 of geotextile material is shown in dashed line and has a first helical seam 92 that corkscrews in one direction with a first pitch. An outer layer 93 of geotextile material surrounds the inner layer 91 and has a second helical seam 94 that corkscrews in a second direction that is the opposite of the direction in which the first helical seam 92 of the inner layer 91 corkscrews. In this embodiment, the one helical seam 92 is generally normal to the other helical seam 94 and thus intersects the other helical seam 94 as each seam 92, 94 winds around its respective layer 91, 93 of geotextile material. Thus, one might say that the pitch of the first helical seam 92 is generally out of phase with the pitch of the second helical seam 94. In this embodiment, the two helical seams 92, 94 further strengthen the container 90 by acting as might two oppositely wound reinforcing ropes wrapped around the container along the length thereof in opposite directions. Each helical seam 92, 94 resists stresses in a different region of the container 90 so that the combination of the two seams provides a stronger overall container.

Figure 11A:
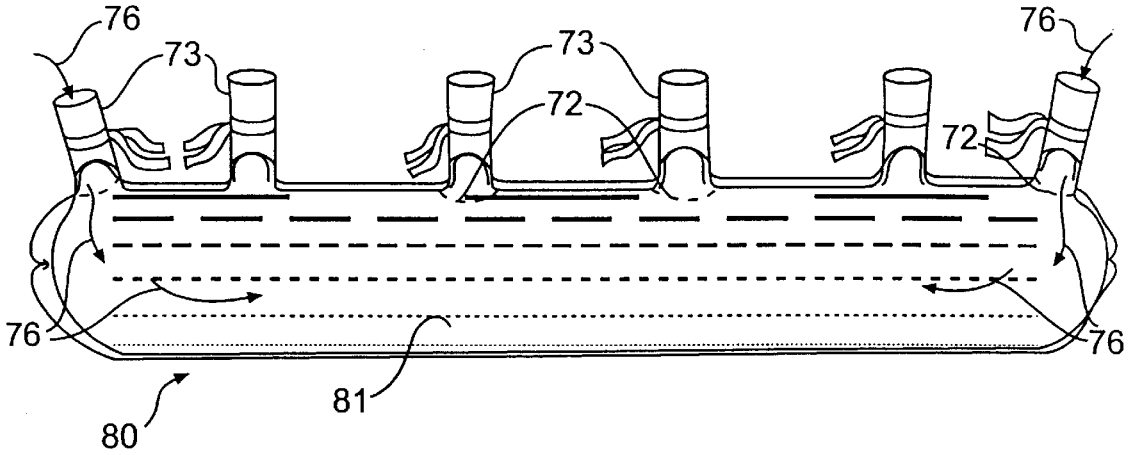
FIGS. 11A, 11B, and 11C show partially cut away side plan views of geotextile bags being filled with material.
Figure 11B:
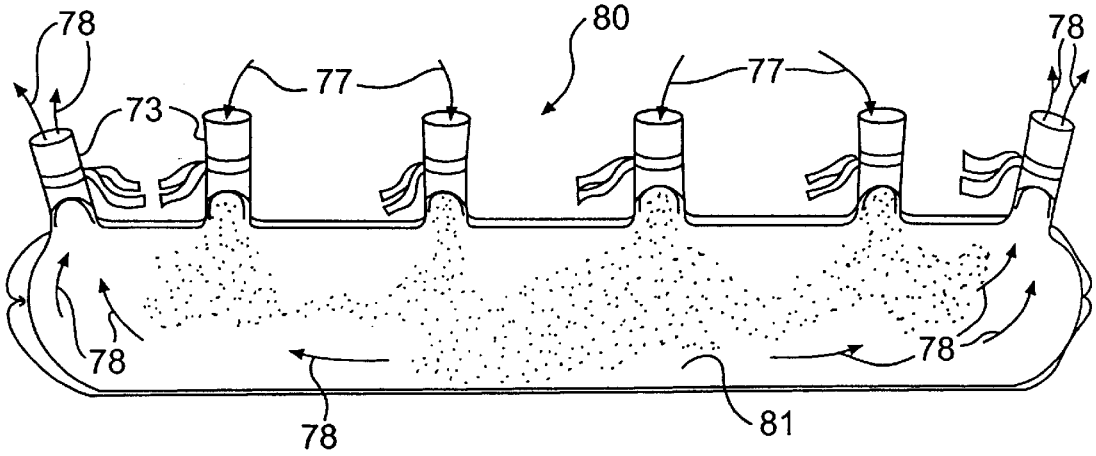
Figure 11C:
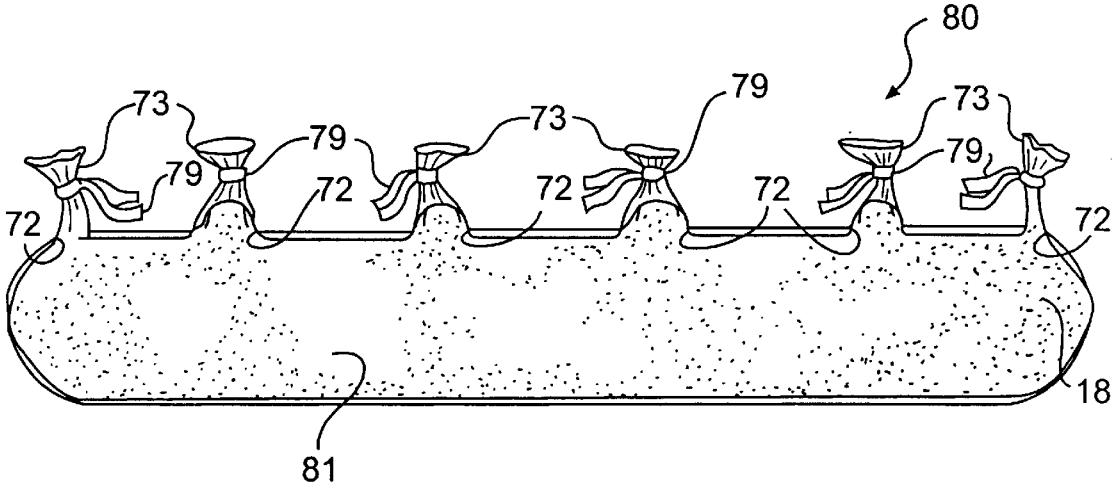

As schematically shown by the arrows designated 76 in FIG. 11A, inner cavity 81 of geotextile container 80 can be inflated by pumping water into same via one or more chimneys 73 and port holes 72 associated therewith and located at the top of the container 80. As schematically shown by the arrows designated 77 in FIG. 11B, fill material is introduced into the inner cavity 81 of container 80 via one or more chimneys 73 and port holes 72 associated therewith and located at the top of the geotextile container 80. Assuming the fill material includes both water and solid matter 18 such as sediment, which tends to fall out of suspension and settle to the bottom of the container under the influence of gravity, the inner liner 68 can be formed of material that is non-permeable to water. As shown schematically by the arrows designated 78 in FIG. 11B, as the solid matter 18 takes up space inside the inner cavity 81 of geotextile container 80, water becomes expelled through those port holes 72 and associated chimneys 73 that are not being used for pumping the fill material into the inner cavity 81 of the geotextile container. As shown in FIG. 11C, once the geotextile container is filled to the desired level, each of the port holes 72 is closed off in any conventional manner. As shown in FIG. 11C, tie-offs 79 are used to collapse the chimneys 73, but other more permanent closure mechanisms such as bolted plates can be used to bolt each port hole 72 closed.

Moreover, if the container is intended to contain fill material that includes silt, which tends to remain in suspension rather than settle to the bottom of the container, inner layer 68 can be formed of water permeable geotextile fabric. In this case, as the solid matter 18 takes up space inside the inner cavity 81 of geotextile container 80, water becomes expelled through the pores in the inner layer 68 and outer layer 69 rather than through holes 72 and associated chimneys 73 that are not being used for pumping the fill material into the inner cavity 81 of the geotextile container.

FIG. 13 schematically illustrates what happens to each multi-layer seam when the container becomes filled with the fill material. The butterfly seam S depicted in FIG. 13 can be considered a seam in the sheet of geotextile material that forms the outer layer 69 of a double-layer container 80 such as shown in FIG. 12 for example. As shown in FIG. 13 for example, when the inner cavity 81 of container 80 is filled with the fill material 18, an outwardly directed force will be imparted on the inside surface 82 of the inner layer 68 of the container 80. Moreover, the weight of the fill material will apply pressure against each sewn flange 41 and its associated line of stitching disposed inside the inner cavity 81 of the container 80. With the sewn fabric flanges so oriented, it is believed that the fill material flattens the flange against the inside surface 82 of the layer of geotextile material in which the flange is formed and thereby directs the outwardly directed stress forces from the weight of the fill material, in a perpendicular direction against the side of the fabric flange. For example, as schematically shown in FIG. 13, flange 41 is flattened against the inside surface 85 of sheet 50 (which may be composed of a first sheet 21 and a second sheet 31 in some embodiments) and forms the outer layer 69 of container 80. In this way, the force of the fill material is believed to press together the opposed faces of fabric in the flange portion of the seam S rather than wedging or prying the flaps of fabric apart. It is believed that this pressure acts to reinforce the seam S by keeping the multiple thicknesses of material in the seam S pressed together. Instead of the internal pressure acting to pry the seam apart, the pressure appears to act to keep the seam from separating.

While a preferred embodiment of the invention has been described using specific terms, such description is for illustrative purposes only, and it is to be understood that changes and variations may be made without departing from the spirit or scope of the following claims.

What is claimed is:

1. A geotextile container comprising:

an elongated first sheet of geotextile material having an elongated first side edge and an elongated first end edge, said first end edge being contiguous with said first side edge and shorter in length relative to said first side edge, said first sheet further defining a first border region near said first side edge;

an elongated second sheet of geotextile material having an elongated first side edge and an elongated first end edge, said first end edge of said second sheet being contiguous with said first side edge of said second sheet and shorter in length relative to said first side edge of said second sheet, said second sheet further defining a second border region near said first side edge of said second sheet;

said second sheet being disposed with respect to said first sheet in a position such that said first side edges are generally aligned and said first border region opposes said second border region;

a means of joining said first and second sheets along said opposed first and second border regions to form at least part of a seam;

said first and second sheets being joined to each other to form an elongated tubular body that is permanently closed at opposite ends and defining an inner cavity between said sheets, at least one of said sheets defining an inlet opening therethrough, said inlet opening being configured to permit fill material to be introduced into said cavity and contained therein; and wherein said part of said seam composed of said first and second border regions is disposed within the inner cavity of the container whereby an outwardly radially directed force imparted on the container by the fill material will be directed against said part of said seam composed of said first and second border regions.

2. A container as set forth in claim 1, wherein:

said joining means includes a first line of stitching joining said first and second sheets in said respective first and second border regions near said respective first side edges of said first and second sheets.

3. A container as set forth in claim 1, wherein said joined border regions form part of a butt seam.

4. A container as set forth in claim 1, wherein said first and second side edges are folded to form a butterfly seam and wherein said joining means includes a first line of stitching in the form of a plurality of double lock stitches.

5. A geotextile container as set forth in claim 1, wherein the circumference of said tubular body is at least eighteen feet.

6. A geotextile container as set forth in claim 1, wherein the length of said tubular body is at least twelve feet.

7. A geotextile container as set forth in claim 6, wherein the circumference of said tubular body is at least eighteen feet.

8. A geotextile container as set forth in claim 1, wherein the rupture strength of said geotextile material composing each said sheet is in the range of about 200 to 1000 pounds of force.

9. A geotextile container as set forth in claim 1, wherein said geotextile material composing each said sheet is woven from synthetic fibers.

10. In a method of making an elongated tubular geotextile bag having elongated sides and closed opposed ends relatively shorter than the sides and being of the type having an elongated first seam disposed in at least one side to extend generally axially along the length of the bag and the bag further having at least one second seam disposed in at least one end of the bag, which is of the type having an inner cavity for containing fill material and at least one inlet opening defined through the side, a method of reinforcing the first seam, comprising the steps of:

providing at least two elongated sheets of geotextile material, wherein each said sheet has a first elongated side edge and a first elongated end edge that is contiguous with said first elongated side edge and relatively shorter than said side edge, and wherein each sheet further has a second elongated side edge contiguous with said first elongated end edge and disposed generally opposite said first elongated side edge, and wherein each sheet further has a second end edge contiguous with said first and second elongated side edges and relatively shorter than said side edges and disposed generally opposite said first elongated end edge;

disposing a first one of said sheets with respect to a second one of said sheets such that said first side edges are generally aligned and said sheets are touching one another along at least a border region near said first side edges;

applying a first line of stitching that joins said first and second sheets, said first line of stitching being disposed in said border region near said respective first side edges of said first and second sheets;

applying a second line of stitching that joins said first and second sheets near said respective first end edges of said first and second sheets;

forming an elongated tubular sack of preselected size and that is closed at a first end of said sack formed by said joined first end edges, has said lines of stitching disposed outside said sack, and defining an opening at a second end of said sack, and then turning said sack inside out so that said lines of stitching become disposed inside said sack whereby an outwardly directed force imparted on said sack by the fill material will be directed against said lines of stitching;

defining an inlet opening through at least one of said sheets; and accessing said second end edges of said sheets via said inlet opening to join said second edges from within said cavity.

11. A method as set forth in claim 10, wherein before applying said first line of stitching, said first side edges of said first and second sheets are folded back against said respective first and second sheets to form a multi-layer, flanged seam, and said first line of stitching includes a plurality of double lock stitches.

12. In a method of making a tubular geotextile bag having opposed sides and opposed ends and being of the type having an elongated first seam disposed in at least one side to extend generally axially along the length of the bag and the bag further having at least one second seam disposed in at least one end of the bag, which is of the type having an inner cavity for containing fill material, a method of reinforcing the first seam comprising the steps of:

providing at least two elongated sheets of geotextile material, wherein each said sheet has a first elongated side edge and a first elongated end edge that is contiguous with said first elongated side edge, and wherein each sheet further has a second elongated side edge contiguous with said first elongated end edge and disposed generally opposite said first elongated side edge, and wherein each sheet further has a second end edge contiguous with said first and second elongated side edges and disposed generally opposite said first elongated end edge;

disposing a first one of said sheets with respect to a second one of said sheets such that said first side edges are generally aligned and said sheets are touching one another along at least a border region near said first side edges;

applying a first line of stitching that joins said first and second sheets, said first line of stitching being disposed in said border region near said respective first side edges of said first and second sheets;

applying a second line of stitching that joins said first and second sheets near said respective first end edges of said first and second sheets;

joining together sufficient sheets in the same manner as described above for said first and second sheets in order to form an elongated tubular sack of preselected size and that is closed at a first end of said sack formed by said joined first end edges, has said lines of stitching disposed outside said sack, and defining an opening at a second end of said sack, and then turning said sack inside out so that said lines of stitching become disposed inside said sack whereby an outwardly directed force imparted on said sack by the fill material will be directed against said lines of stitching;

forming a port hole near said opening in said second end of said sack;

pulling said second end edges at said second end of said sack through said port hole to the outside of said sack;

applying a third line of stitching that joins said second end edges to close said second end of said sack; and pushing said second end edges with said third line of stitching back through said port hole into the inside of said sack to form the inner cavity of the bag whereby an outward force imparted on the bag by the fill material will be directed against said third line of stitching.

13. A geotextile container comprising:

an elongated tubular body that is permanently closed at opposite ends and defining an inner cavity that is configured to receive and retain fill material;

an inlet opening defined through said body and configured to permit fill material to be introduced into said cavity and contained therein; and said tubular body including at least an elongated first sheet of geotextile material having an elongated first side edge and an elongated first end edge, said first end edge being contiguous with said first side edge and shorter in length relative to said first side edge, said first sheet further defining a second elongated side edge contiguous with said first elongated end edge and disposed generally opposite said first elongated side edge, and wherein said first sheet further including a second end edge contiguous with said first and second elongated side edges;

each of said first and second elongated side edges and said first and second end edges being included in at least one seam and each said seam including a flange;

wherein each said flange of each said seam is disposed within said inner cavity of said body whereby an outwardly radially directed force imparted on the container by the fill material will be directed against each said flange of each said seam.

* * * * *